United States Patent [19]

Nishikawa

[11] Patent Number: 4,640,206

[45] Date of Patent: Feb. 3, 1987

[54] HEMMING APPARATUS

[75] Inventor: Masahiko Nishikawa, Osaka, Japan

[73] Assignee: Pegasus Sewing Machine Mfg. Co., Ltd., Osaka, Japan

[21] Appl. No.: 767,408

[22] Filed: Aug. 20, 1985

[30] Foreign Application Priority Data

Aug. 21, 1984 [JP] Japan ..... 59-127179[U]
Oct. 18, 1984 [JP] Japan ..... 59-157946[U]

[51] Int. Cl.[4] ..... D05B 35/04
[52] U.S. Cl. ..... 112/143
[58] Field of Search ..... 112/143, 153, 147, 141, 112/142, 10

[56] References Cited

U.S. PATENT DOCUMENTS

| | | | |
|---|---|---|---|
| 3,752,100 | 8/1973 | Sharp | 112/143 |
| 3,786,768 | 1/1974 | Kosrow et al. . | |
| 3,865,058 | 2/1975 | Rovin et al. | 112/143 |
| 4,037,547 | 7/1977 | Marforio | 112/143 X |
| 4,055,127 | 10/1977 | Sharp | 112/143 |

*Primary Examiner*—Werner H. Schroeder
*Assistant Examiner*—Andrew M. Falik
*Attorney, Agent, or Firm*—Flynn, Thiel, Boutell & Tanis

[57] ABSTRACT

A hemming apparatus for a sewing machine includes a hem folding attachment which guides a cloth edge portion into the sewing machine and an aiding apparatus which prefolds the cloth edge portion into an S-shaped hem before it reaches the hem folding attachment. The aiding apparatus includes a rotatably supported free roll, a ring thereon for setting the position of the cloth edge portion, a fitting mechanism engageable with the top of the hem, an under guide plate engageable with the bottom of the hem, and a base guide spaced above the under guide plate. As the edge portion of the cloth extending between the hem folding attachment and free roll and defining the upper fold of the hem is advanced toward the hem folding attachment, an adjacent portion of the cloth is moved by the fitting mechanism gradually further into the region between the base guide and the under guide plate so that the hem assumes the prescribed S-shape.

16 Claims, 16 Drawing Figures

HEMMING APPARATUS

This invention relates to a hemming apparatus for a sewing machine and, more particularly, to an aiding apparatus for hemming which is designed to bend the cloth into an S-letter shape prior to its entry into the hem folding attachment and then to guide it to the hem folding attachment.

BACKGROUND OF THE INVENTION

In carrying out hemming with a hem folding attachment, it has hitherto been the general practice to feed cloth while guiding it in a sewing direction by supporting the cloth with the left hand and bending the end of the cloth into an S-letter form along its hem with fingers of the right hand before it enters the hem folding attachment. However, such an operation required special skill, which does not allow everyone to carry out hemming easily.

U.S. Pat. No. 3,786,768 discloses an apparatus furnished with an apparatus for prefolding the hem prior to its entry into a hem folding attachment. Said apparatus is applicable only to hemming of a tubular workpiece, or in other words an endless hem such as that on a skirt. It is designed to have a tubular workpiece placed on the apparatus and to then circulate it once to form an S-letter shaped fold for the hem, followed by driving of the sewing machine to circulate once more the workpiece to effect hemming. According to this patent, it is necessary to form first an S-letter shaped prefold all along the hem. Accordingly, it is not possible to carry out hemming while simultaneously feeding the cloth into the apparatus and bending it into an S-form. According to said apparatus, folding the hem into an S-letter form is also made by pushing the edge portion of the cloth toward the center of the cloth. However, as shown in FIG. 15, as the edge portion of the cloth is pushed in, the edge of the cloth comes to shift gradually toward the center of the cloth, so that the edge of the cloth is deviated toward the left of the lower folding edge E of the cloth and the product value is reduced.

SUMMARY OF THE INVENTION

It is an object of the present invention to provide an apparatus by which anybody can easily carry out hemming without requiring special skill and in the same manner as an ordinary sewing operation.

The objects of the invention are met by providing a hemming apparatus which creates an S-shaped hem in a piece of cloth and which includes a hem folding attachment supported on a machine bed in front of a needle dropping point and an aiding apparatus for hemming disposed in front of the hem folding attachment so as to prefold the hem into the S-shape. The aiding apparatus includes a free roll supported for rotation about an axis on a front side of the machine bed, a position setting arrangement for setting the position of an edge of the cloth on the free roll, the position setting arrangement being supported on or near the free roll and being engageable with the edge of the cloth extending from the free roll toward the hem folding attachment, a fitting arrangement engageable with an upper surface of the hem, an under guide plate engageable with a lower surface of the hem, and a base guide disposed a predetermined distance above the under guide plate. The fitting arrangement, under guide plate and base guide are disposed between the hem folding attachment and the free roll, and form the hem gradually into the prescribed S-shape as the cloth advances from the free roll to the hem folding attachment, an upper side fold of the hem having a width determined by the distance between an end surface of the free roll and the position setting arrangement in cooperation with the base guide, and an underside bent section of the hem being folded gradually more deeply beneath the upper side fold by the under guide plate and fitting arrangement in cooperation with the free roll as the cloth advances toward the hem folding attachment, the fitting arrangement moving the underside bent section of the cloth progressively farther between the base guide and under guide plate as the cloth advances.

Other features and advantages of the present invention will become apparent from the following description on the embodiment given with reference to the drawings.

BRIEF DESCRIPTION OF THE DRAWINGS

FIG. 5 is a perspective view of the hemming apparatus and a sectional view of the cloth and the hem being sewn in.

DETAILED DESCRIPTION OF A PREFERRED EMBODIMENT

Figure 1:
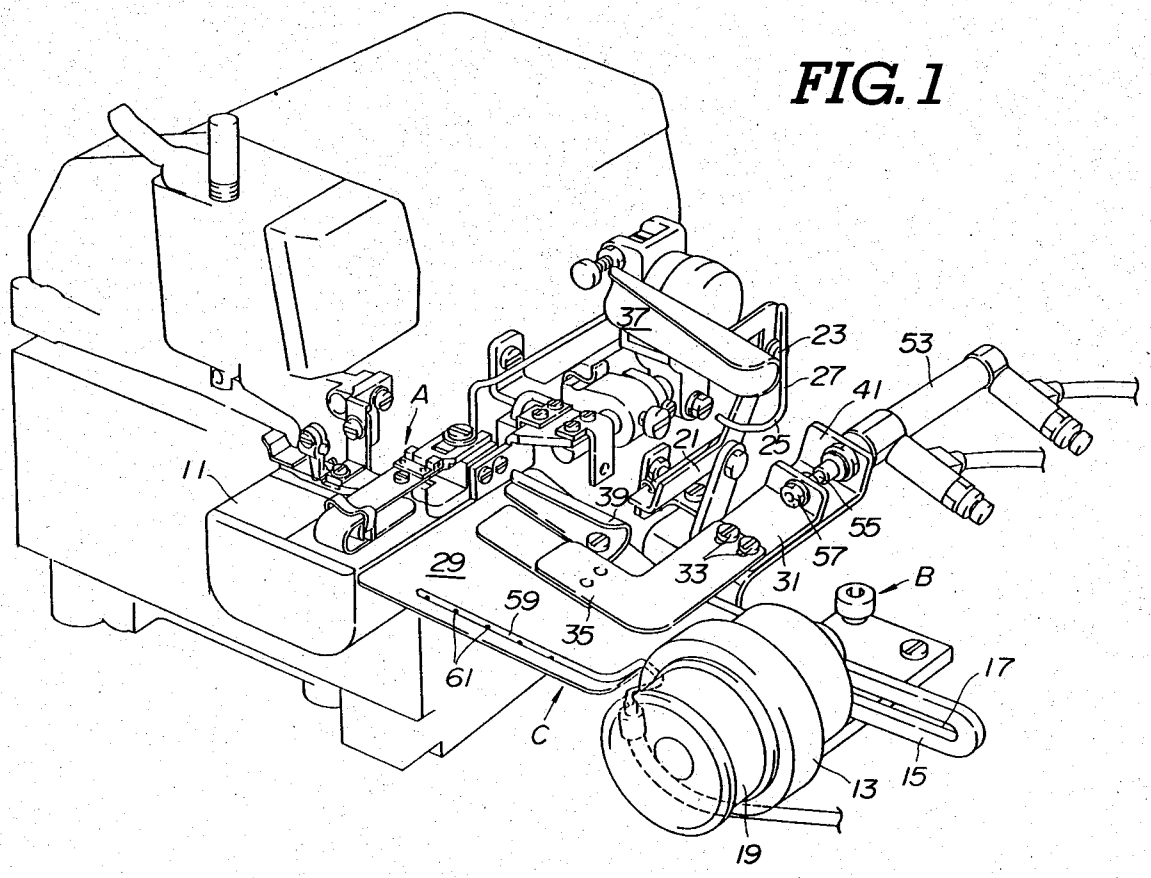
FIG. 1 is a perspective view of a sewing machine furnished with a hemming apparatus, showing the state where a base guide and a cloth fitting means are in non-working positions.
Figure 3A:
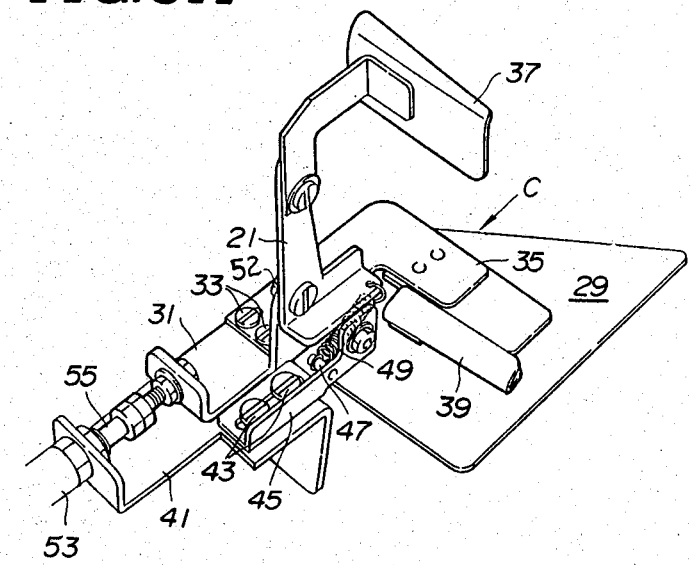

On a bed 11 (FIG. 1) of the sewing machine there is provided a known hem folding attachment designated as a whole by A and located on the front side of the seam forming zone. On the front side of the attachment there is provided an aiding apparatus for prefolding the hem into S-shape prior to hemming. The aiding apparatus for hemming shown as a whole by B comprises a free roll 19 rotatably supported at a suitable position in the slot 17 of the arm 15, a guide ring 13 encircling said free roll 19 and supported thereon in a manner so that its position is adjustable in an axial direction, and a cloth guide apparatus C lying between said free roll 19 and bed 11. The cloth guide apparatus C comprises further a bent resilient wire 27 which is supported at an end of a bell crank lever 21 with a screw 23 and has a bent portion 25 which can resiliently contact the end surface of said free roll in a working position (see, FIG. 4), an under guide plate 29 which extends from the vicinity of the contact of said bent portion 25 with the roll 19 to the upper surface of the bed with its left side edge in FIG. 1 gradually diverging from the hem in a left oblique direction with respect to the hem feeding direction, an L-shaped base guide 35 which is provided over the under guide plate 29 at a suitable height above the plate 29, a cloth fitting plate 37 which is supported at an end of said bell crank lever 21 in the same manner as the resilient wire 27 and is designed to press over the bending portion of the bent cloth hem, and a cloth edge guide 39 fixed to the right end portion (in FIG. 1) of the base guide 35 and designed to guide the edge of the free end of the cloth. The bell crank lever 21 is pivotally supported at its middle part by a movable bracket 31. Between the other end of lever 21 and a pin 47 (FIG. 3A) projecting from a holder 45 which is adjustably secured to a fixed bracket 41 with a screw 43, a spring 49 is provided. By said spring 49, the bell shaped lever 21 is urged to rotate clockwise as shown in FIGS. 3A and 3B, and the range of its rotation is limited by a pin 51.

To the fixed bracket 41 an air cylinder 53 is secured. Piston rod 55 is secured to said movable bracket 31 by nuts 57. On the under guide plate 29 an air pipe 59 (FIG. 1) is disposed. This air pipe is connected with a compressed air source, and on one side thereof there are provided nozzles 61 at suitable intervals. By the scraping of the cloth with the edge of the plate 29, movement of cloth in the direction of folding in is reduced. Simultaneously, by blowing out air from the air pipe 59, the cloth comes to be pulled in a direction reverse to the folding-in direction, by which folding of an unnecessarily large amount of cloth is prevented.

Figure 3B:
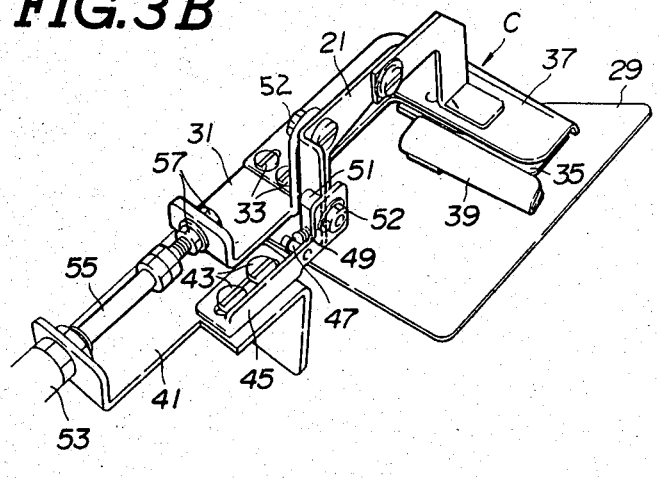

In carrying out hemming, in order to set cloth W onto the aiding apparatus B for hemming, the piston rod 55 is moved back into its cylinder 53 from the condition shown in FIG. 3B. By this, the movable bracket 31 retreats, and the base guide 35 retreats with the cloth edge guide 39 to the non-working position in which it does not engage the cloth W. The retraction of the movable bracket 31 causes anticlockwise pivoting of the bell crank lever 21 about a pin 52 due to engagement with a pin 51, thereby holding cloth fitting plate 37 at a location spaced above the under guide plate 29 (FIG. 3A).

Figure 4:
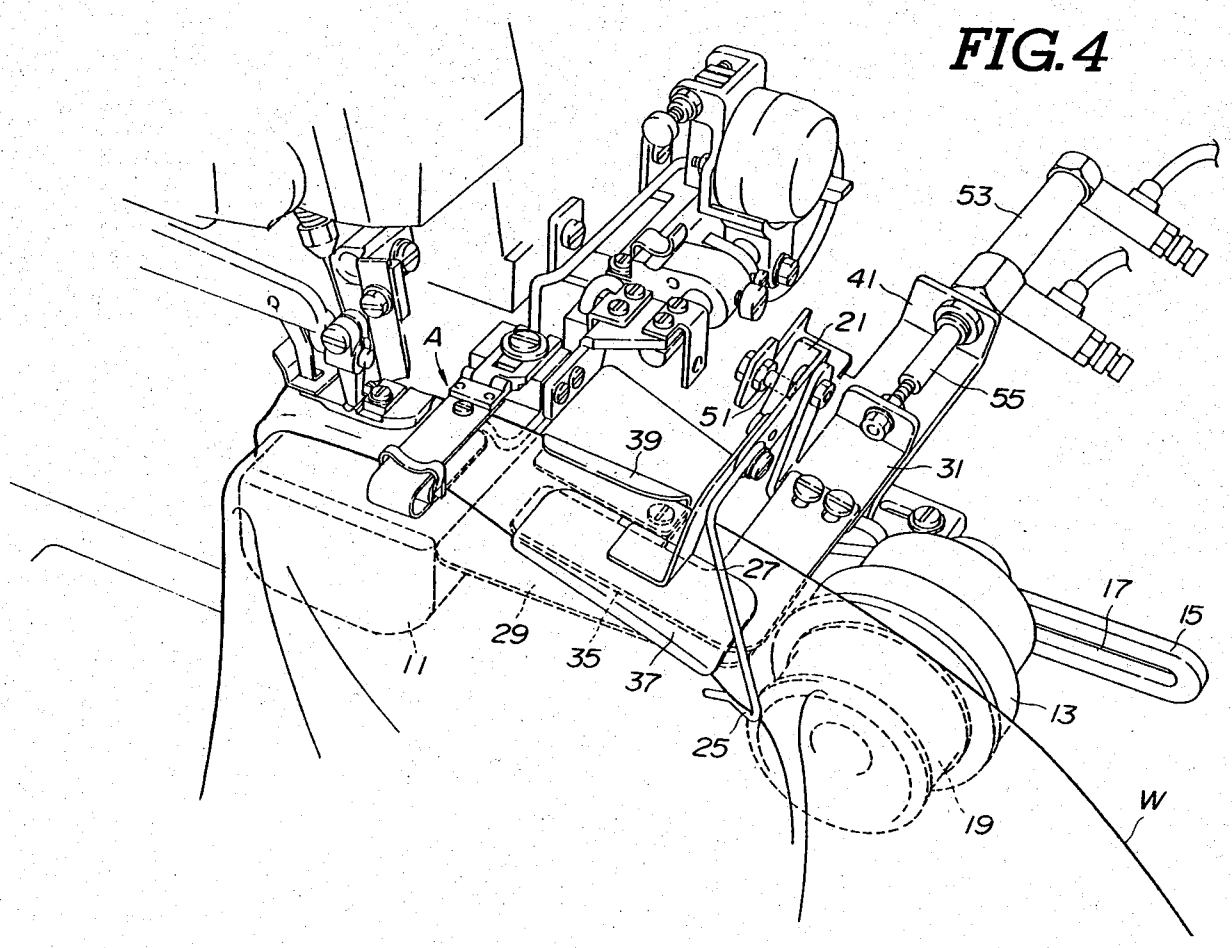
FIG. 4 is a perspective view of the hemming apparatus.

Then, the edge portion at an end of a cloth W is folded into an S-letter shape and is inserted in the hem folding attachment A, and the side edge of the cloth is placed against the guide ring 13 on the free roll 9, after which the piston rod 55 is advanced. With the advance of the piston rod 55, the base guide 35 and the cloth edge guide 39 advance to the working position, and the cloth fitting plate 37 presses the bent portion of the cloth W from above the base guide, and also the bent end 25 of the resilient wire 27 lightly presses the cloth W to the end surface of the free roll 19 (FIG. 4).

Figure 2:
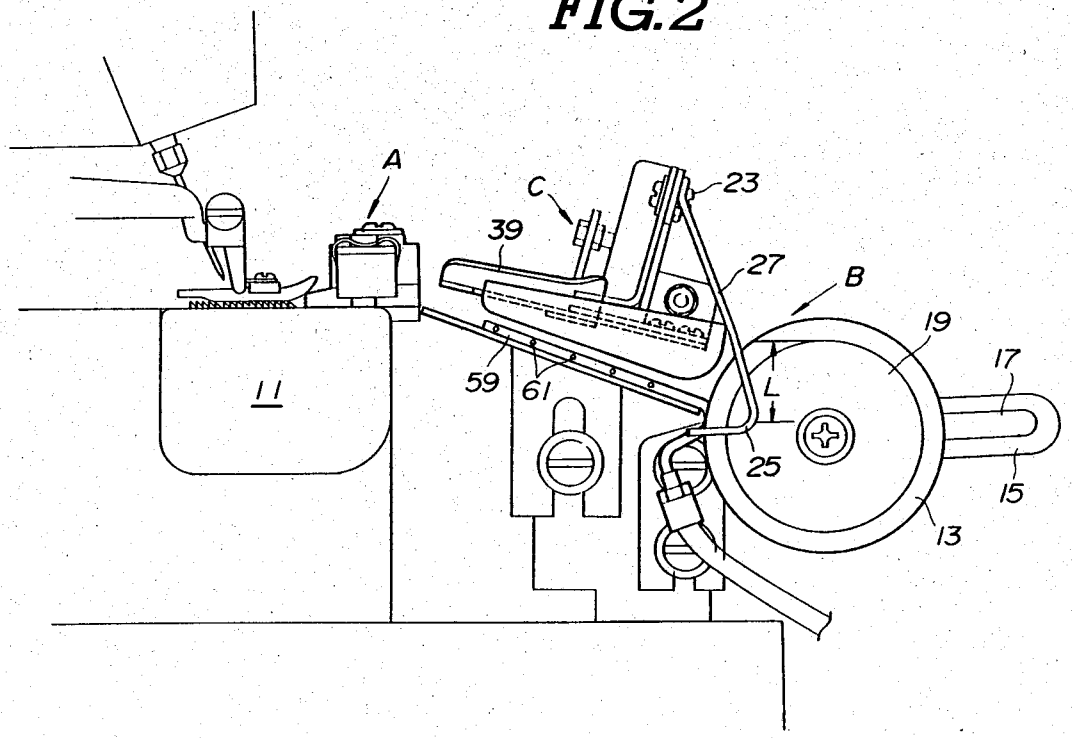
FIG. 2 is a side view of the hemming apparatus as shown in FIG. 1, FIG. 3A and FIG. 3B are partial perspective views of the cloth fitting plate and the base guide in the non-working position and in the working position, respectively.
Figure 5:
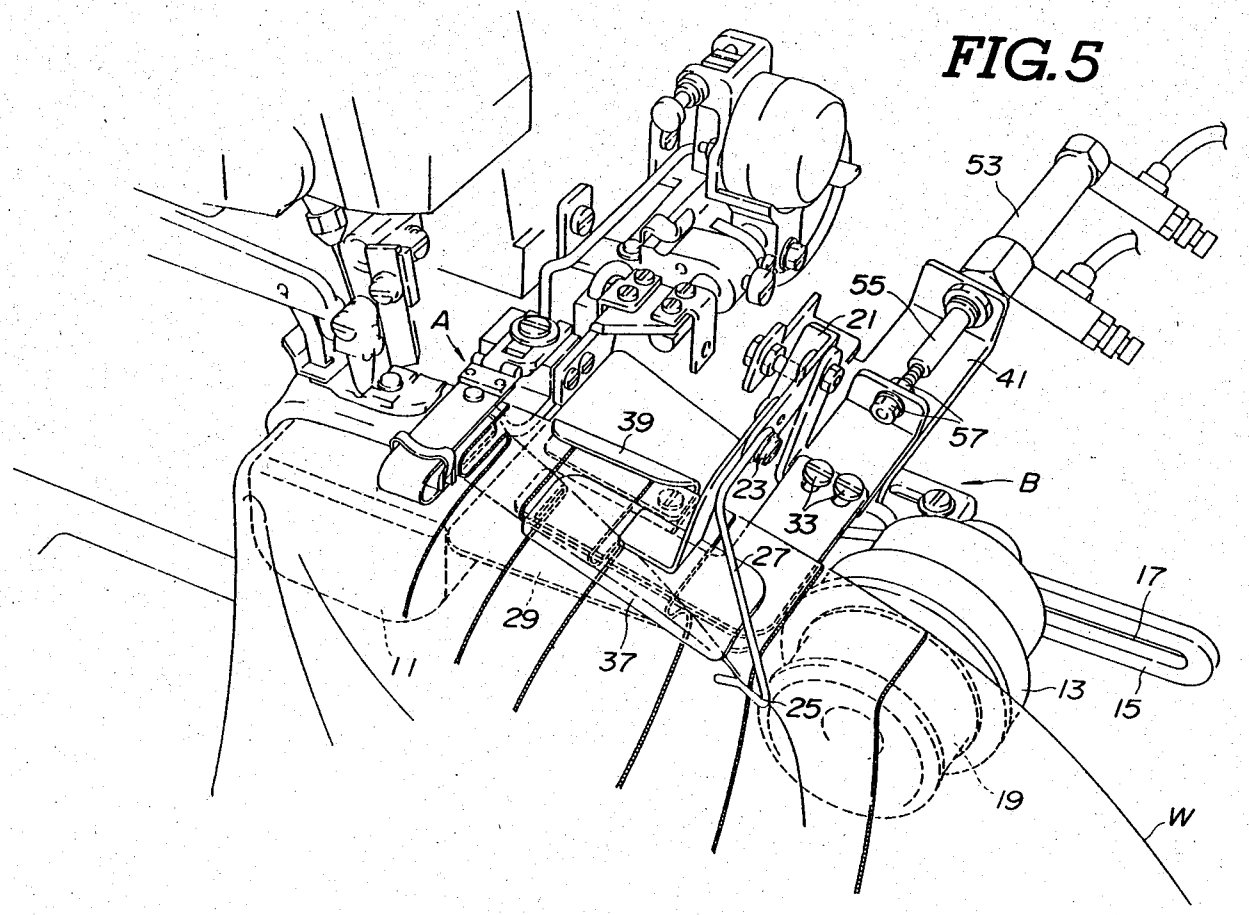
Figure 14:
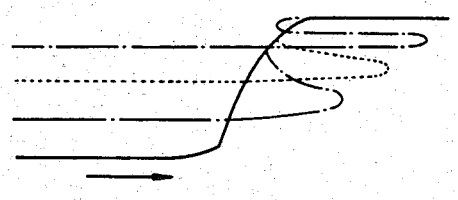
FIG. 14 is a diagrammatic view depicting the progressive folding of the hem.
Figure 15:
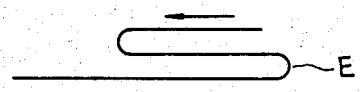
FIG. 15 PRIOR ART
FIG. 15 is a diagrammatic view of a hem folded into an S-shape by a conventional apparatus.

After the cloth W has been thus positioned, the sewing machine is driven, and with the side edge of the cloth extending along the guide ring 13, the cloth is fed in the same manner as in an ordinary hemming operation. As a result, the cloth equivalent to the distance L (FIG. 2) between the bent end 25 of wire 27 and the upper end of the free roll 19 (FIG. 2) is pushed gradually more deeply into the region between the under guide plate 29 and the base guide 35 as it moves the hem folding attachment A as shown in FIG. 5 and FIG. 14.

Figure 6:
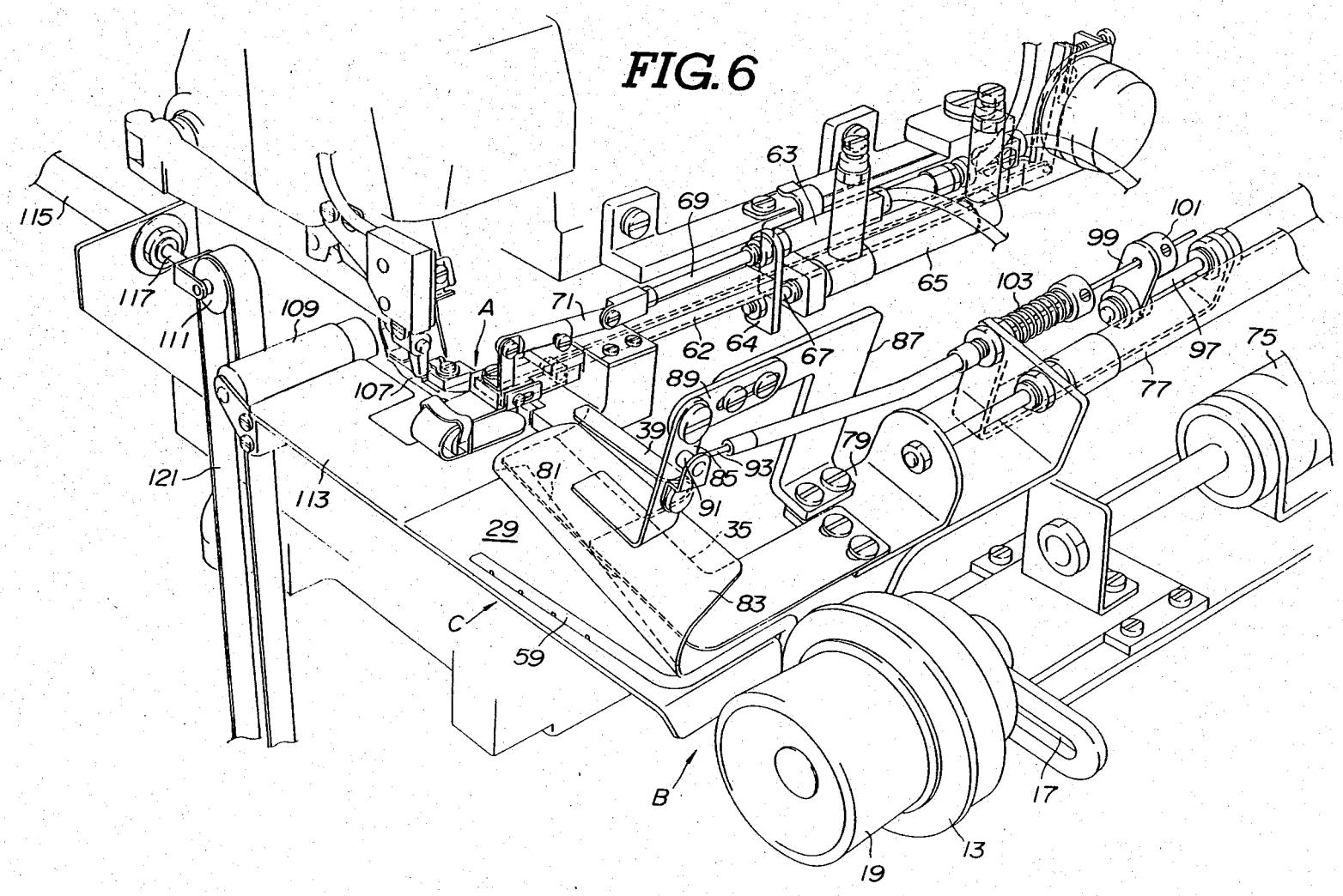
FIG. 6 is a perspective view of another embodiment, showing the condition where a bent cloth fitting plate, base guide, and hem folding apparatus are in working positions.
Figure 7:
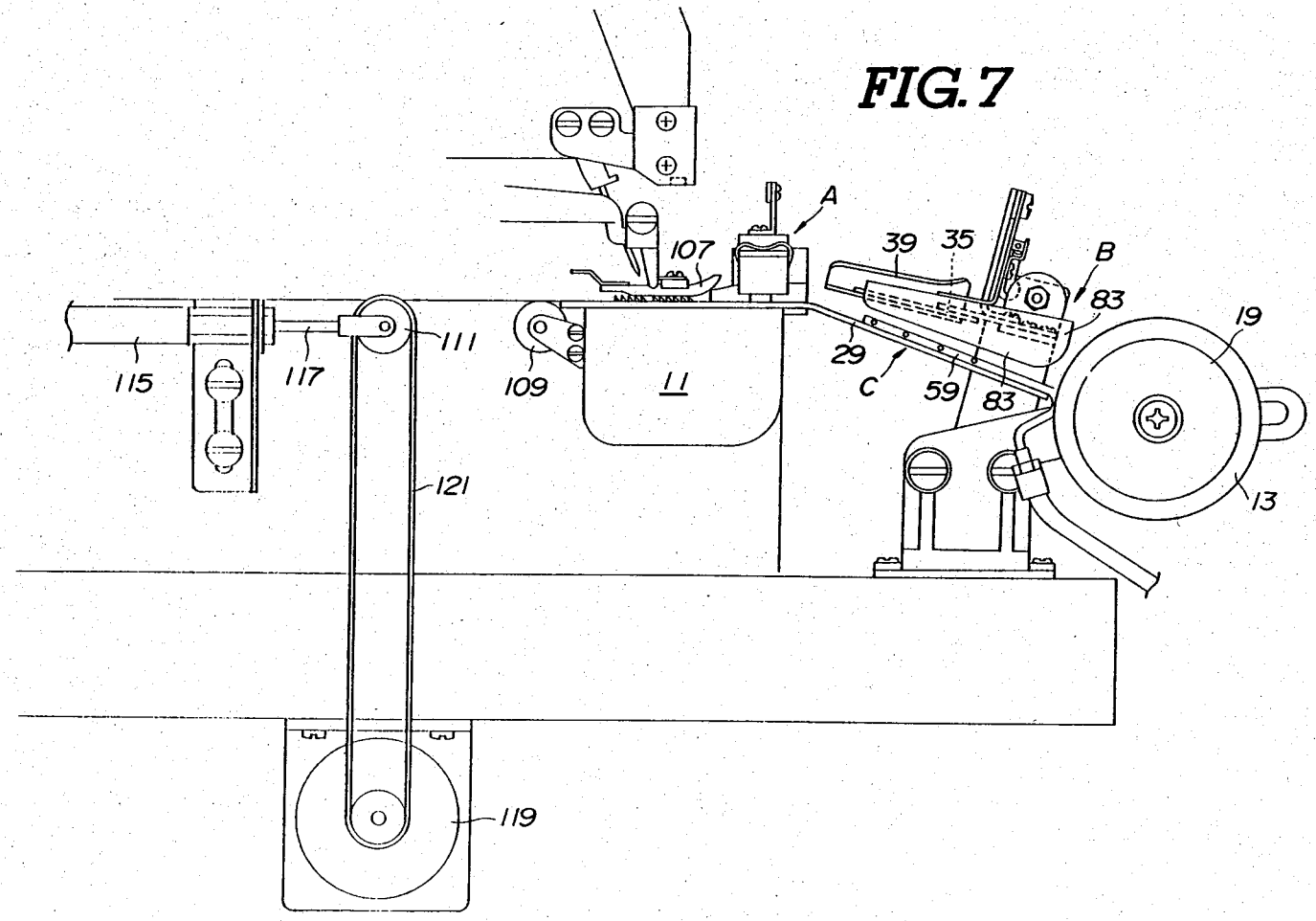
FIG. 7 is a side view of the apparatus shown in FIG. 6.

FIG. 6 and FIG. 7 show another embodiment of this invention. In said figures, the same numerals have been attached to elements having the same construction as in the above embodiment.

A hem folding attachment A having the cross-sectional shape of a U is pivotally supported on an end of a slider 62. To the other end of the slider 62, a bracket 64 is fixed and on the bracket 64 an air cylinder 63 and the piston rod 67 of an air cylinder 65 are connected. Slider 62 can thus reciprocate at right angles to the cloth feeding direction. The hem folding attachment A is also connected to a piston rod 69 of the air cylinder 63 by a link 71, and rises and falls under central of the air cylinder 63. The rising and falling of the hem folding attachment takes place either when the hem folding attachment is at its most advanced position or according to its reciprocation.

Aiding apparatus B for hemming comprises the guide ring 13, the free roll 19, and a cloth guide apparatus C. The free roll 19 is movable between the working position as shown in FIG. 6 in which the hemming is carried out and a non-working position (FIG. 12) receded sideways of the working position.

The cloth guide apparatus C comprises an under guide plate 29 on which an air pipe 59 is disposed, a base guide 35 fitted to a movable bracket 79 which advances and recedes in a direction at right angles to the hem feeding direction under control of an air cylinder 77 and is furnished with a cloth edge guide 39, and a cloth fitting plate 83 formed by a curved plate which can reciprocate in a direction at right angles to the hem feeding direction and is pivotally supported so that it can rise and fall, its side nearest the center of the cloth being bent to give it a J-letter cross-sectional shape along the feeding direction, and being bent further inwardly so that the bend extends approximately along a diagonal line connecting a side of the end of the plate 83 near said hem folding attachment A, which enters into the space under said base guide 35, and a lower end of the plate 83 which is near said free roll 19 and is bent downwardly (FIG. 6). And so an edge portion 81 of said plate 83 is formed to become gradually wider toward the hem folding attachment A, and has its edge located on a line connecting the right end of the hem folding attachment A and the left end of the free roll 19. In order to allow the bent cloth fitting plate 83 to reciprocate and also pivot, a plate holder 85 is pivotally supported on a link 89 secured to an L-shaped angle plate holder 87 which is supported by a movable bracket 79. To a pin 91 at the middle part of the plate holder 85, an end of the wire 93 is connected. To the other projecting end of the wire 93, which extends through the stopper 99 secured to the end of the piston rod 97, a collar 101 is fixed.

Figure 9:
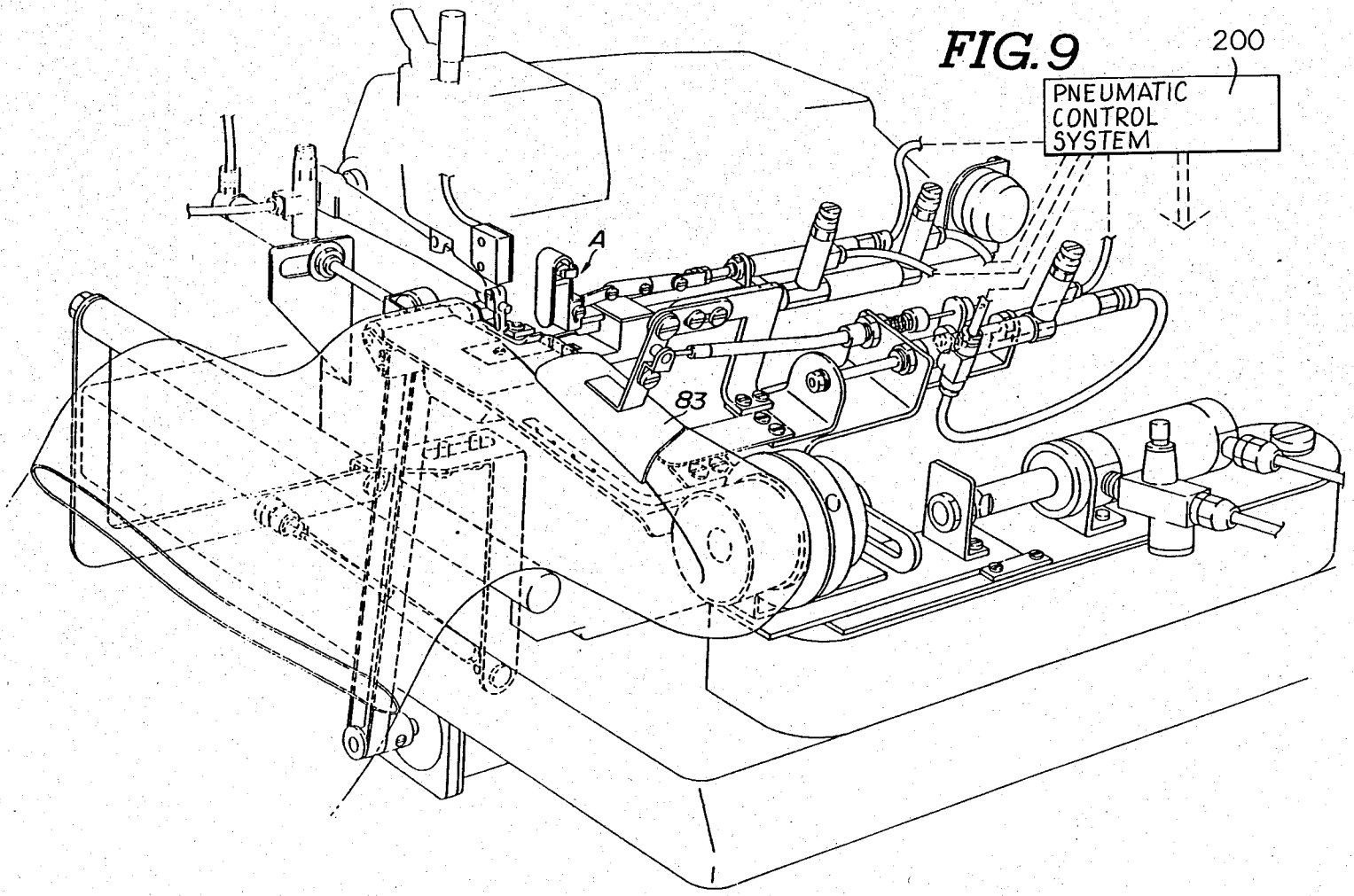
FIG. 9 is a perspective view showing the state where the bent cloth fitting plate and the base guide are changed over to the working position.
Figure 10:
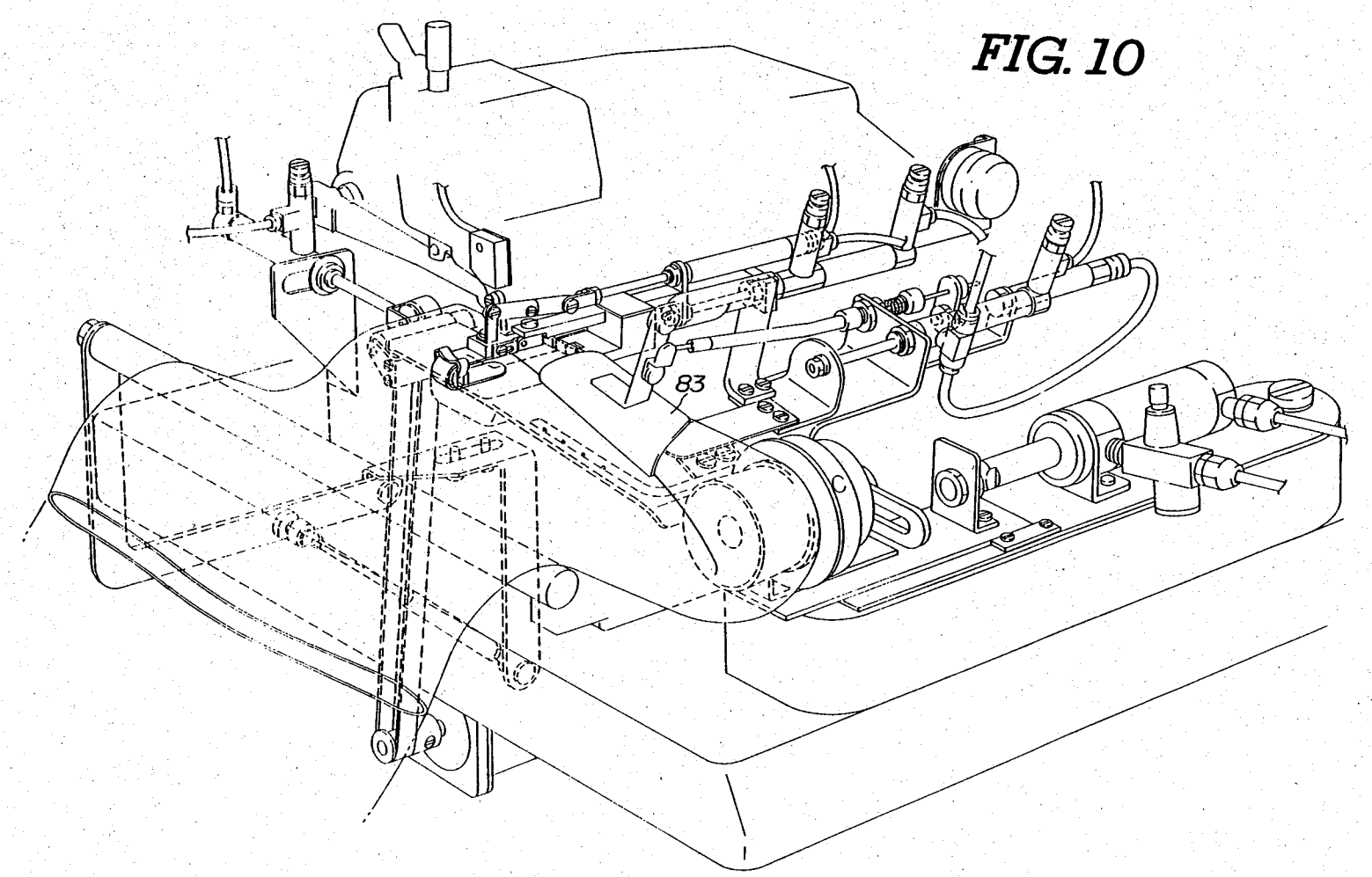
FIG. 10 is a perspective view showing the state where the hem folding attachment is advanced and caused to pivot down onto the cloth.

Now, when the movable bracket 79 is advanced by the air cylinder 77, the wire 93 is also pulled in the same direction against the action of the coil spring 103 until collar 101 engages the stopper 99, and the bent cloth fitting plate 83 is advanced. When the movable bracket 79 advances further even after the collar 101 has engaged the stopper 99, the bent cloth fitting plate 83 pivots downward around the pin 91 to hold the cloth W. Then, the edge portion 81 near the hem folding attachment enters under the base guide 35, and pushes the cloth into the space between the under guide plate 29 and the base guide 35 (FIG. 9).

Figure 8:
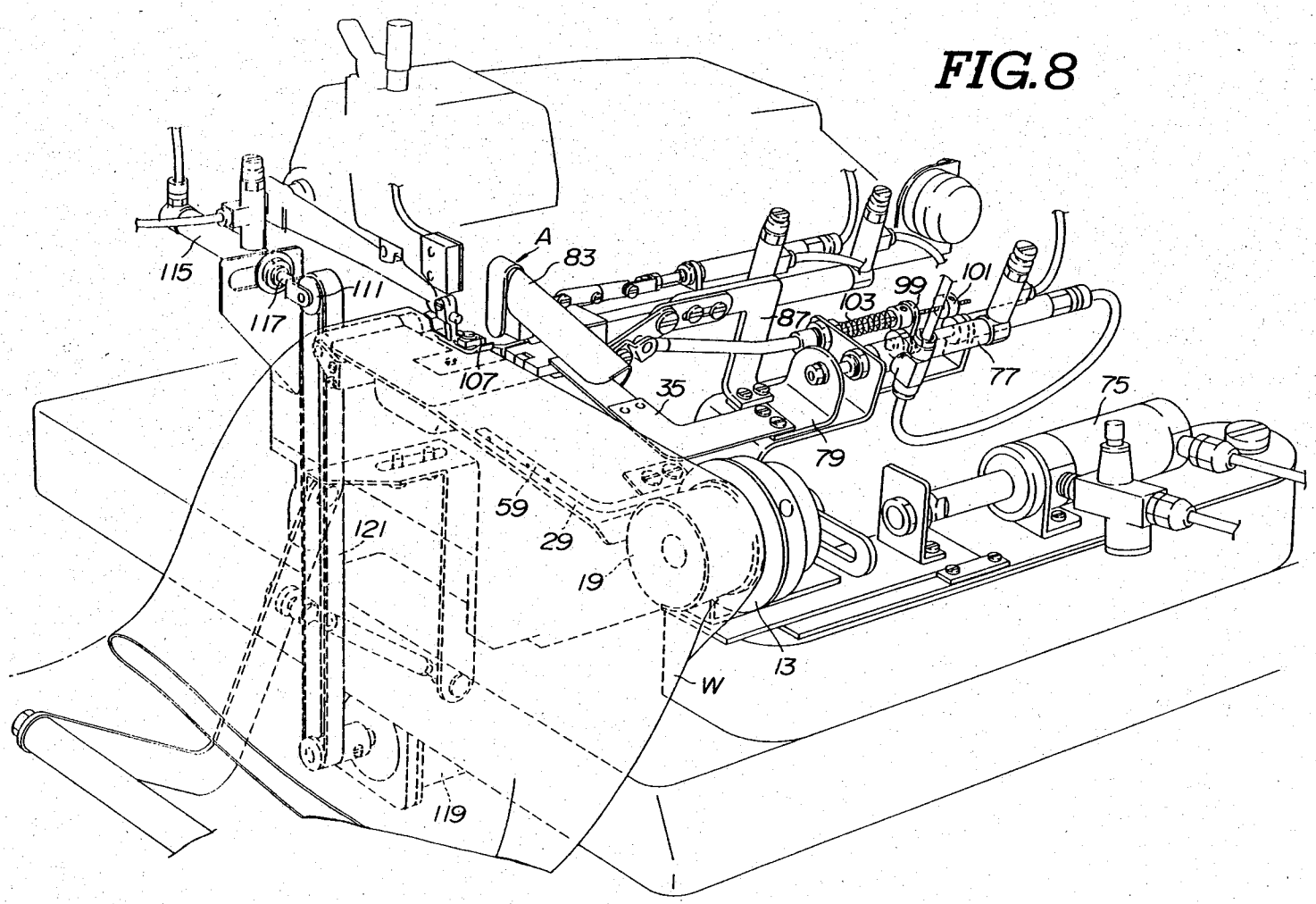
FIG. 8 is a perspective view showing the state where the hem of a tubular cloth is placed on the sewing machine.
Figure 12:
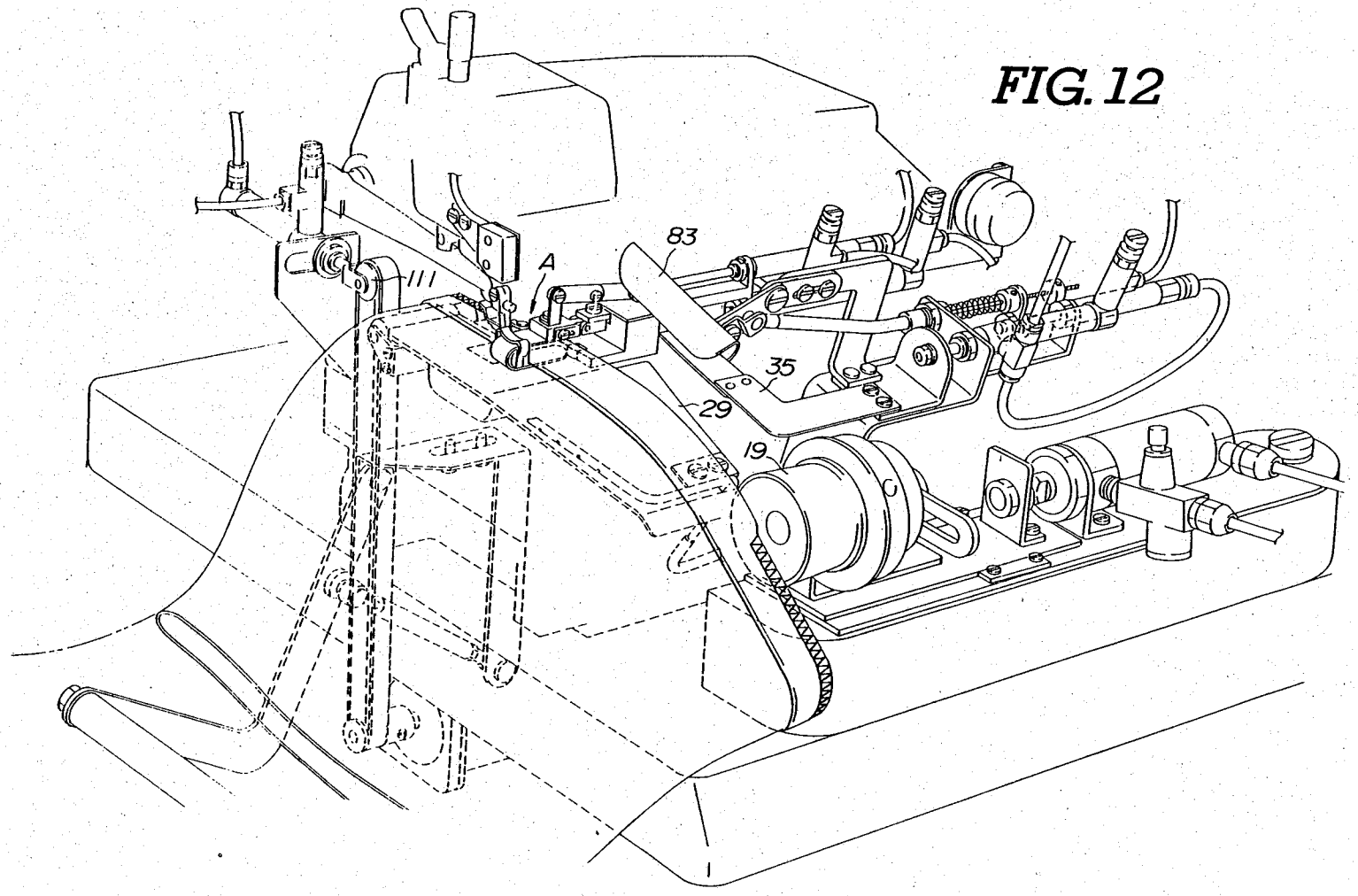
FIG. 12 is a perspective view showing the state where the initial portion of hemming has circulated to reach the front side of the base guide and where the bent cloth fitting plate and the base guide have been changed over to the non-working positions.
Figure 13:
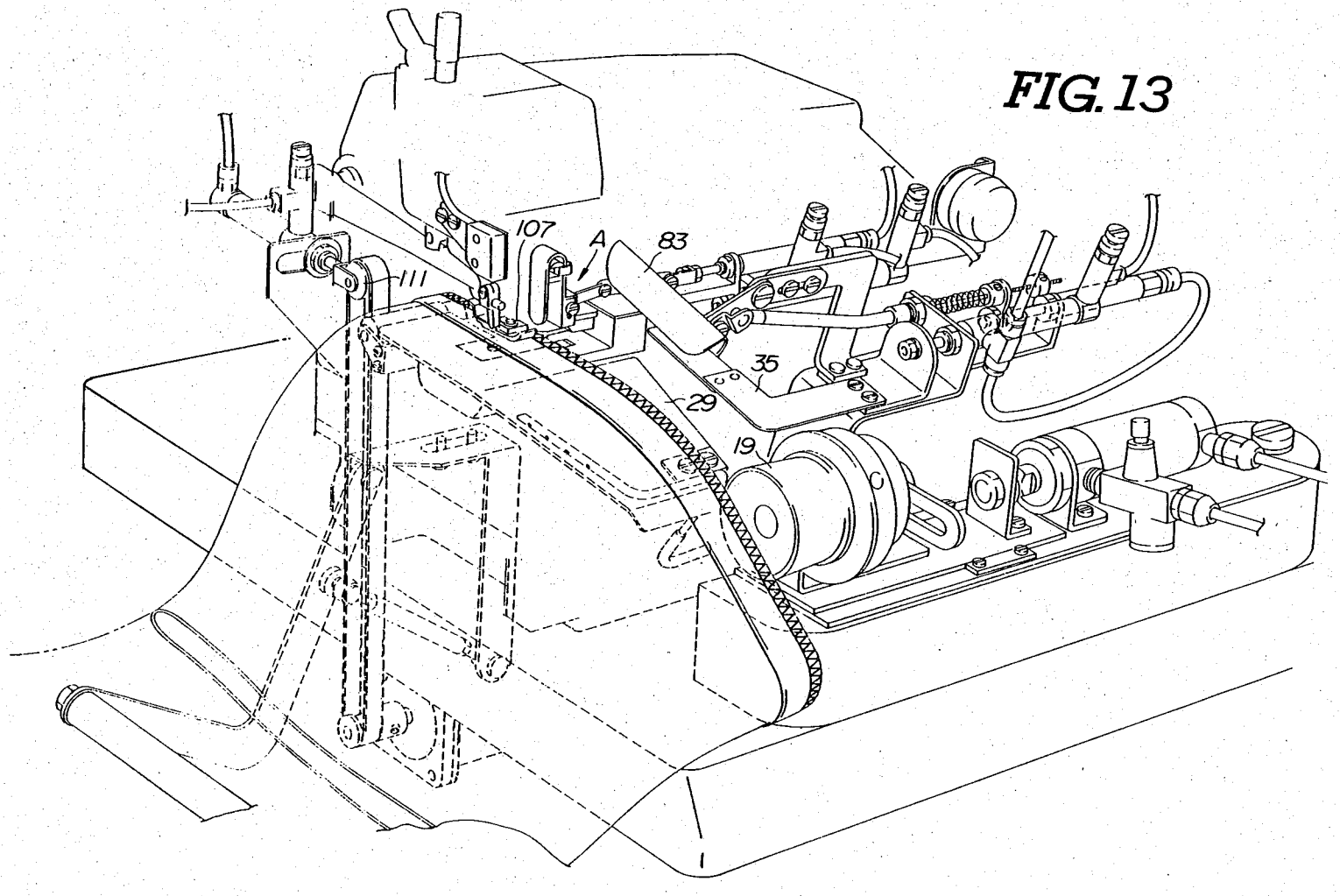
FIG. 13 is a perspective view showing the state where the sewing cycle has been completed and the hem folding attachment has been changed over to the non-working position.

Changeover from such working position to the non-working position shown in FIGS. 8, 12 and 13 is effected by the retraction of the movable bracket 79, reversing the sequence in the above description. That is to say, when the movable bracket 79 recedes, the bent cloth fitting plate 83 retracts rightwardly pivoting up. At this time, the wire 93 is also pulled back by the action of the spring 103, but its pulling back action is inhibited by the stopper 99 fitted to the piston rod 97 which advances simultaneously, and the wire 93 is pushed out by the further advancing stopper against the action of the coil spring 103, and as a result the bent cloth fitting plate 83 pivots upward.

The bed 11 is also provided at its rear part with a pair of rolls comprising a feed roll 109 and a driving roll 111. The feed roll 109 is rotatably supported by the bed. The driving roll 111 is rotatably supported at the end of the piston rod 117 of the air cylinder 115, and is movable between a working position pushed to the feed roll 109 and a non-working position separated from the feed roll 109 by the advance and retraction of the piston rod 117. The driving roll 111 is driven through a belt 121 by the motor 119.

Now, in the present apparatus, the case of carrying out hemming of a tubular workpiece is explained with reference to FIGS. 8 to 12. In carrying out hemming, the base guide 35, bent cloth fitting plate 83, hem folding attachment A and driving roll 111 are respectively set to their non-working positions and the presser foot 107 is moved to the lifted state, under which conditions the edge portion of the cloth is placed over the free roll 19 and the feed roll 109 and then is led under the presser foot 107, and its position setting is made by aligning the cloth end along the guide ring 13 (FIG. 8). Then, the base guide 35 is advanced to the working position above the under guide plate 29, and thereafter or simultaneously therewith, the bent cloth fitting plate 83 is advanced and pivoted down to its working position. The cloth W is pushed by edge portion 81 of plate 83 into a space between the under guide plate 29 and the base guide 35, and the driving roll 111 is advanced to press the hem against the feed roll 109 (FIG. 9).

Then, the hem folding attachment A advances in an upwardly pivoted state (FIG. 9), is then pivoted downwardly so that it lies flat on the cloth at the most advanced position (FIG. 10), retreats by a designed amount from the advanced position to the working position so that a U-shaped folding part of it enters into engagement with the S-letter formed bent portion of the cloth. Then, the driving roll 111 is driven to rotate by the motor 119 to advance the hem by a suitable amount.

Figure 11:
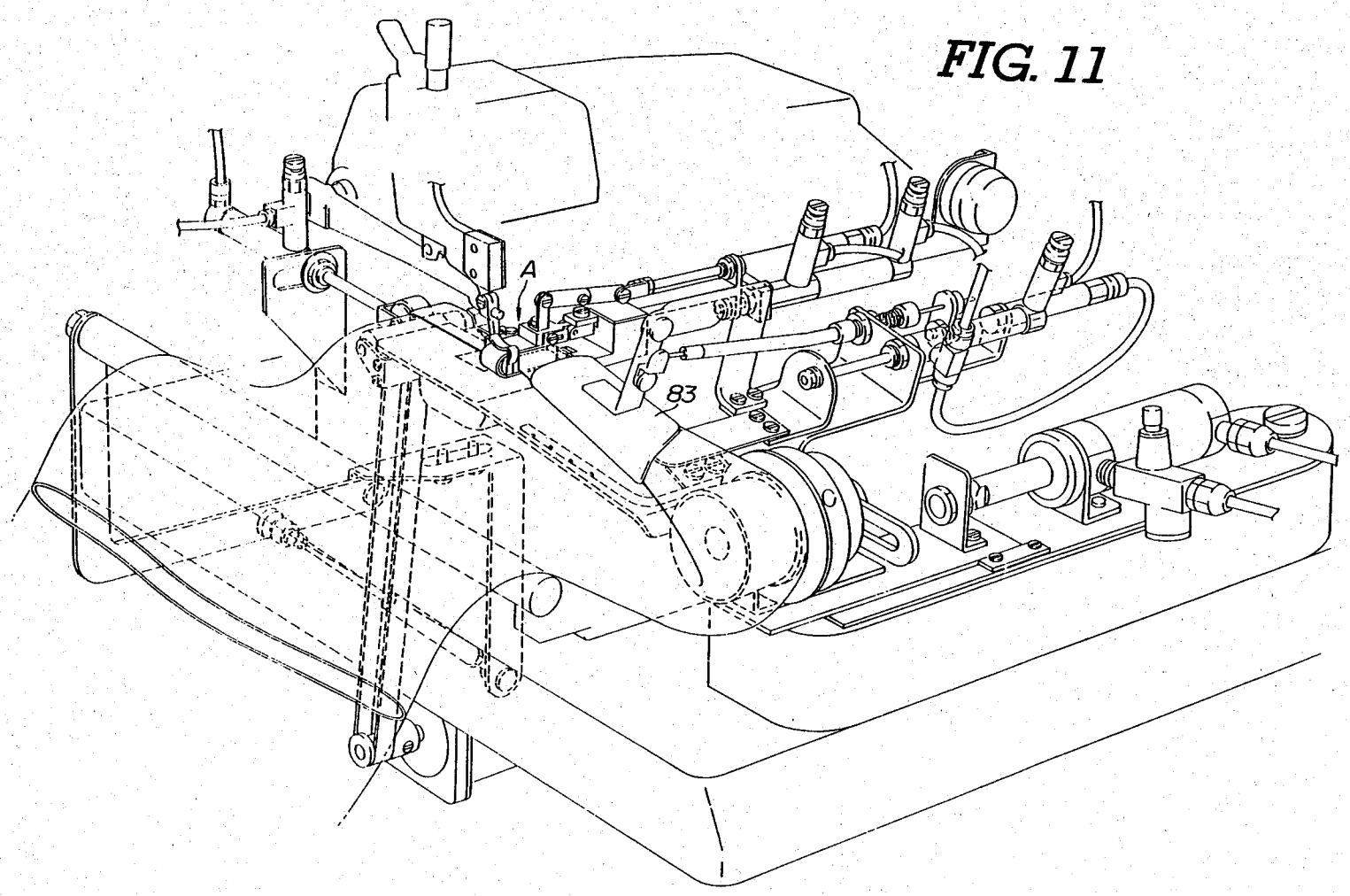
FIG. 11 is a perspective view showing the state where the hem folding attachment is changed over to the working position and the hem of the tubular cloth is moved by a suitable amount to have a certain amount of folding width formed.

As it passes to the hem folding attachment A through the aiding apparatus B for hemming, the hem is successively bent in S-letter form (FIG. 14). When the cloth has been fed to a certain extent and the folds have come to be stably formed at a certain width, the motor 119 is stopped to stop cloth feeding (FIG. 11). Thereafter, the driving roll 111 is retracted from the feed roll 109 and the presser foot 107 is lowered to drive the sewing machine. Thereafter, hemming is done, and when the endless hem has been almost completely sewed so that the initial hemmed portion apparatus, the free roll 19, the base guide 35 and the bent cloth fitting plate 83 are each retracted to the non-working position (FIG. 12). Then, the hem folding attachment A is also changed over to the non-working position and the hemming is completed completely over the hem of the cloth.

Lifting and lowering of the presser foot 107, driving or stopping of the motor 119, movement of the base guide, bent cloth fitting plate, and hem folding attachment A, halting of the sewing machine operation, etc. are either effected manually by the worker's operation of pedals or automatically by a conventional sequence control apparatus 200 (FIG. 9).

With this inventive apparatus, hemming can be easily performed in a manner very similar to an ordinary sewing operation by simply placing the edge portion of a cloth to be hemmed on the free roll, setting the position setting member to properly position the cloth edge, inserting an S-shaped end of the hem into the hem folding attachment across the under guide plate, moving the base guide and fitting mechanism into their operational positions, and then starting the sewing machine and feeding the cloth so that its edge runs along the position setting member.

In the inventive apparatus, the position setting member is the ring supported on the free roll, a circumferential line is provided on the peripheral surface of the free roll, and a guide is provided which is independent from the free roll and is supported on a suitable fixed object, the ring and guide preferably being adjustable relative to each other in directions axially of the free roll so that the folding width of the hem can easily be adjusted.

In the preferred embodiments, the base guide advances and retreats in a transverse direction, thereby simplifying the mechanism which actuates it while ensuring that, when hemming a tubular workpiece requiring an endless hem, the end of the hem which has already been sewed is not caught by the base guide. By having the base guide advance and retract in transverse directions, disengagement thereof from the cloth layers is facilitated.

In the first preferred embodiment disclosed herein, the resilient wire on the fitting member is adjustable so as to permit variation of the location at which it contacts the free roll, thereby permitting the width of the folded hem to be adjusted. In order to adjust the position of the resilient wire, a holder therefor is slidably supported and is fixedly held at a suitable position by a screw.

One object of the invention is, when bending the hem into an S-shape, to prevent the upper side fold of the hem from sliding toward the center of the cloth relative to the part of the hem therebelow so as to prevent the lower folded part of the hem from protruding well beyond the edge of the cloth. For this purpose, the inventive apparatus holds the hem with a cloth fitting plate to give frictional resistance to movement of the upper side fold of the hem relative to the rest of the hem.

In the second preferred embodiment disclosed herein, which has the cloth fitting plate bent in a J-letter cross-sectional shape and used in combination with the free roll, position setting arrangement, under guide plate and base guide, the end portion of the fitting plate which enters gradually farther under the base guide in a direction toward the hem folding attachment pushes the cloth into the space between the under guide plate and the base guide, so that the resilient wire of the first embodiment is unnecessary. The bent cloth fitting plate and the base guide are movable between working and non-working positions to facilitate insertion of the hem in the non-working position, and their movements are effected by a common operating mechanism so as to simplify the apparatus. When the bent cloth fitting plate and base guide have been moved from their non-working positions to their working positions, the cloth is pushed gradually more deeply into the space between the under guide plate and the base guide as it moves toward the hem folding attachment, and material from only the cloth side is pulled up and folded in to create the hem, with the result that there is no tendency for the upper fold of the hem to shift toward the center of the cloth.

The hem folding attachment is movable between a working position and a non-working position as in a known device, but it is desirable that it not cause the upper fold of the hem to shift toward the center of the cloth when moving from its non-working position to its working position. Therefore, according to the present invention, only the U-shaped folder section and not the tongue shaped second folder section of the hem folding attachment shown in U.S. Pat. No. 3,786,768 is used, and in addition the U-shaped folder section is supported to move reciprocally in a horizontal direction and also to pivot to and from an upwardly raised position. When moving to its working position, it is advanced horizontally and then pivoted down from the upwardly raised position (or is advanced and simultaneously pivoted down from its raised condition), and after it is pivoted down onto the hem it is retracted horizontally so that a leg thereof becomes inserted between the lower layers of the S-shaped hem. For changeover to its non-working position, the folder section is moved in a manner opposite that just described.

In the present invention, the hem can be prefolded and inserted in the hem folding attachment and, after lowering of the presser foot, the sewing machine can immediately be started to carry out hemming. However, in order to more accurately achieve a uniform fold width along the entire hem, it is desirable to first feed the hem in a lengthwise direction by a suitable amount as it is being inserted into the hem folding attachment and before starting to sew, and to thereafter start sewing when the folded hem width has become constant. Accordingly, the present invention provides the pair of rolls, one of which can be rotatably driven, behind the bed of the sewing machine in such manner that one roll can be brought into contact with or moved away from the other, whereby with the hem held between the two rolls a specified lengthwise movement of the hem can be effected.

During feeding of the hem to the hem folding attachment, the cloth is folded gradually further into the region between the under guide plate and the base guide. A possible problem here is that there is a tendency for the folded amount of cloth to become unnecessarily large, because the lower folded part of the hem tends to shift away from the center of the cloth relative to the needle drop point of the sewing machine in response to the cloth feeding action of the sewing machine. The present invention avoids this by having the side edge of the under guide plate engage the underside of the cloth and diverge away from the hem in the cloth feeding direction, so that the cloth drooping therefrom is urged by the edge of the plate in a direction which counters the tendency of the cloth to shift on the plate in the direction of the hem. Further, the under guide plate is inclined in a manner so that its side nearest the machine bed is higher than the side thereof nearest the free roll, which enhances the aforesaid urging of the cloth away from the hem by the side edge of the plate. For similar reasons, the present invention also provides the air pipe on the under guide plate in order to blow air onto the cloth in a direction away from the hem through several nozzles or slits.

What is claimed is:

1. A hemming apparatus for a sewing machine which creates an S-shaped hem in a piece of cloth, comprising a hem folding attachment supported on a machine bed in front of a needle dropping point and an aiding apparatus for hemming disposed in front of said hem folding attachment so as to prefold the hem into said S-shape, said aiding apparatus for hemming including:

(a) a free roll supported for rotation about an axis on a front side of said machine bed, (b) position setting means for setting the position of an edge of the cloth on said free roll, said position setting means being supported on or near said free roll and being engageable with the edge of the cloth, the edge of the cloth extending from said free roll toward said hem folding attachment, (c) fitting means for engaging an upper surface of the hem, (d) an under guide plate engageable with a lower surface of the hem, and (e) a base guide disposed above said under guide plate a predetermined distance, said fitting means, said under guide plate and said base guide being disposed between said hem folding attachment and said free roll and forming the hem gradually into the prescribed S-shape as the cloth advances from said free roll to said hem folding attachment, an upper side fold of the hem having a width determined by the distance between an end surface of said free roll and said position setting means in cooperation with said base guide, and an underside bent section of the hem being folded gradually more deeply beneath said upper side fold by said under guide plate and said fitting means in cooperation with said free roll as the cloth advances toward said hem folding attachment, said fitting means moving the underside bent section of the cloth progressively farther between said base guide and said under guide plate as the cloth advances.

2. The apparatus according to claim 1, wherein said position setting means includes a ring which encircles said free roll and rotates synchronously with said free roll, and wherein the axial position of said ring is adjustable along said free roll.

3. The apparatus according to claim 1, wherein said fitting means and said base guide are supported for movement between a working position in engagement with the hem and a non-working position free of engagement with the hem.

4. The apparatus according to claim 1, wherein said under guide plate has thereon an air pipe having an air nozzle which emits pressurized air to urge a portion of the cloth near the hem in a direction away from the hem.

5. The apparatus according to claim 1, including cloth edge guide means for guiding the edge of the cloth and located between said hem folding attachment and said position setting means.

6. The apparatus according to claim 5, wherein said cloth edge guide means is provided on said base guide.

7. The apparatus according to claim 1, wherein said fitting means includes a bent piece of resilient wire, said piece of resilient wire having a portion which resiliently urges the cloth against said end surface of said free roll to keep the hem from drooping from said free roll.

8. The apparatus according to claim 7, wherein said fitting means includes a cloth fitting plate which keeps an upper bent section of the hem positioned between said cloth fitting plate and said base guide so as to facilitate formation of said S-shaped hem.

9. The apparatus according to claim 1, wherein said under guide plate is inclined so that an end thereof adjacent said machine bed is positioned higher than an opposite end thereof adjacent said free roll, and has a side edge which engages an underside of the cloth at a location spaced from the hem and diverges away from the hem in a direction of movement of the hem.

10. The apparatus according to claim 1, wherein said fitting means includes a cloth fitting plate, said cloth fitting plate having an end portion which is bent so that said cloth fitting plate has a J-shaped cross-section, said bent end portion having a width which gradually increases in a direction toward said hem folding attachment and having an edge which extends approximately along a line which is inclined relative to a direction of movement of the hem, said bent end portion extending into a space under said base guide so that said bent end portion pushes the underside bent section of the hem gradually farther into said space between said under guide plate and said base guide and also holds the hem against said base guide.

11. The apparatus according to claim 10, wherein said under guide plate has a side edge which engages an underside of the cloth at a location spaced from the hem and diverges away from the hem in a direction of movement of the hem.

12. The apparatus according to claim 1, wherein said apparatus is adapted to produce an endless hem in a tubular piece of cloth; including means for moving said hem folding attachment to an operational position from a retracted position by advancing said hem folding attachment from said retracted position toward and past said operational position to an advanced position in a condition lifted upwardly above the cloth, by lowering said hem folding attachment to said cloth at said advanced position, and by then moving said hem forming attachment from said advanced position to said operational position in which it is engaged with the hem; wherein said fitting means and said base guide are each movable between positions engaging and spaced from the hem; wherein said sewing machine includes cloth feed means for effecting movement of the cloth during operation of the sewing machine; including a hem feeding apparatus which is provided on a said of said machine bed opposite from said hem folding attachment and is actuable independently from said cloth feed means of said sewing machine, said hem feeding apparatus including a feed roll which is supported adjacent the machine bed for rotation about an axis, and a driving roll which is rotatably supported, can be selectively rotatably driven independently from said cloth feed means of said sewing machine, and which is supported for movement between two positions in which it is respectively spaced from and drivingly engaged with said feed roll; and including control means for causing:

(a) said base guide to move from its position spaced from to its position engaged with the hem extending between said feed roll and said free roll, and said fitting means to simultaneously move from its position spaced from its position engaged with the upper surface of the hem, (b) said driving roll to thereafter move from its position spaced from to its position drivingly engaged with said feed roll, a portion of the cloth being disposed therebetween, (c) said hem folding attachment to thereafter move from its retracted position to its advanced position in said upwardly lifted condition, to then be lowered to said cloth, and to then move from its advanced position to its operational position, (d) said driving roll to then be rotated so that the hem is advanced by a prescribed amount in its direction of movement by the driving roll and feed roll, and said driving roll to thereafter move back to its position spaced from said feed roll, (e) said sewing machine to thereafter carry out hemming while effecting movement of the cloth with said cloth feed means, (f) said fitting means and said base guide to move to their positions spaced from the hem as said sewing machine is carrying out hemming and shortly before hemming of said endless hem is completed, and (g) said hem folding attachment to move to its position spaced from the hem as said sewing machine is carrying out hemming and shortly before hemming of said endless hem is completed.

13. The apparatus according to claim 12, wherein said hem folding attachment moves between its retracted, advanced and operational positions in approximately horizontal directions transverse to a direction of movement of the hem, and moves to and from its lifted condition by pivoting about an axis which extends approximately parallel to the direction of movement of the hem; and wherein said base guide and said fitting means each move between their positions spaced from and engaging the hem in approximately horizontal directions transverse to the direction of movement of the hem, said fitting means also being supported for pivotal movement between positions adjacent and lifted above the cloth and being pivoted from its lifted to its adjacent position as it moves from its position spaced from the hem to its position engaging the hem.

14. The apparatus according to claim 1, wherein said axis of rotation of said free roll is substantially horizontal and extends transversely of a direction of movement of the hem.

15. The apparatus according to claim 14, wherein said end surface of said free roll faces in a direction in which the cloth extends away from the hem.

16. The apparatus according to claim 14, including means supporting said free roll for movement in directions parallel to said axis of rotation thereof.

* * * * *